United States Patent [19]

George

[11] Patent Number: 4,640,561

[45] Date of Patent: Feb. 3, 1987

[54] FLEXIBLE PRINTED CIRCUIT CONNECTOR

[75] Inventor: Melvin J. George, Milford, Mich.

[73] Assignee: Ford Motor Company, Dearborn, Mich.

[21] Appl. No.: 798,549

[22] Filed: Nov. 15, 1985

[51] Int. Cl.[4] ..... H01R 9/09

[52] U.S. Cl. ..... 339/17 F; 339/17 C

[58] Field of Search ..... 339/17 C, 17 F, 217 S, 339/258 R

[56] References Cited

U.S. PATENT DOCUMENTS

| | | | |
|---|---|---|---|
| 3,699,495 | 10/1972 | Raynor | 339/17 C |
| 3,864,007 | 2/1975 | Plyer | 339/17 LC |
| 3,915,544 | 10/1975 | Yurtin | 339/217 R |
| 4,191,441 | 3/1980 | Ryder et al. | 339/17 F |
| 4,348,071 | 9/1982 | Hsieh | 339/75 MP |
| 4,380,359 | 4/1983 | Hoffman et al. | 339/17 F |
| 4,422,128 | 12/1983 | Zurlinden et al. | 339/17 C |

*Primary Examiner*—Neil Abrams

*Attorney, Agent, or Firm*—Paul K. Godwin, Jr.; Clifford L. Sadler

[57] ABSTRACT

A unitary retainer socket device for providing positive interconnection between a male pin conductor of an electrical instrument and exposed conductor runs of a flexible printed circuit material is formed to be inserted into and extend from both ends of an open ended aperture in a rigid panel that supports the flexible printed circuit. A base element is centrally formed in the socket and has spring biasing tabs extending therefrom to prevent insertion of the base element into the support panel aperture and to provide holding forces to the flexible circuit material against the surface of the support panel. Pairs of legs extend from the base element at a distance that exceeds the depth of the support panel aperture so as to extend therethrough. Retrorse tabs are defined at each leg pair to lockingly retain the socket in the aperture by engaging the end of the aperture opposite to the insertive end. Electrical contacts of the socket are compressed against the side walls of the support panel aperture by insertion of the male pin conductor in the socket and provide positive electrical contact to the exposed conductor runs of the printed circuit material that extends into the support panel aperture along the side walls.

7 Claims, 6 Drawing Figures

FIG. 1.
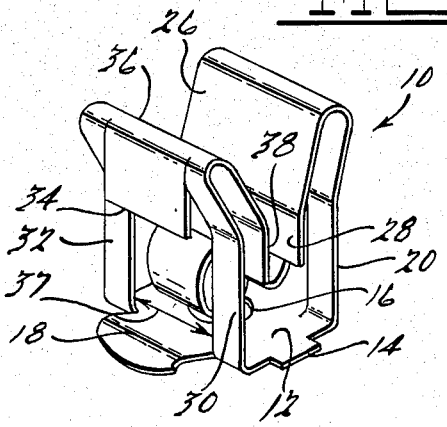
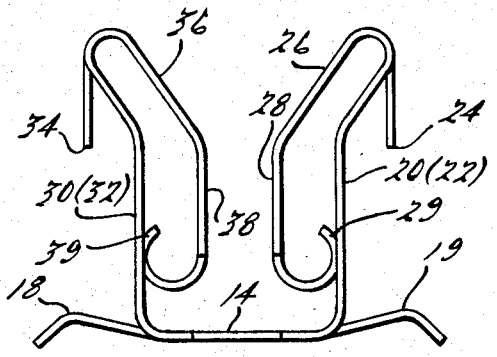
FIG. 2.
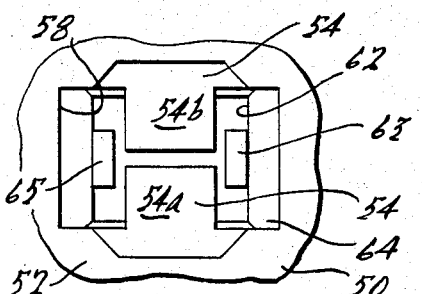
FIG. 3
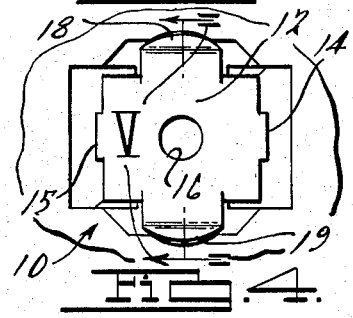
FIG. 4.
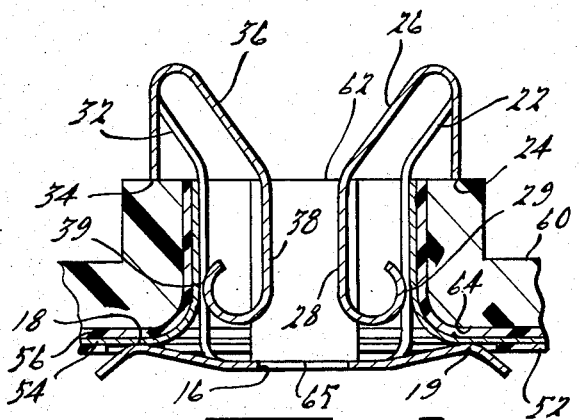
FIG. 5.
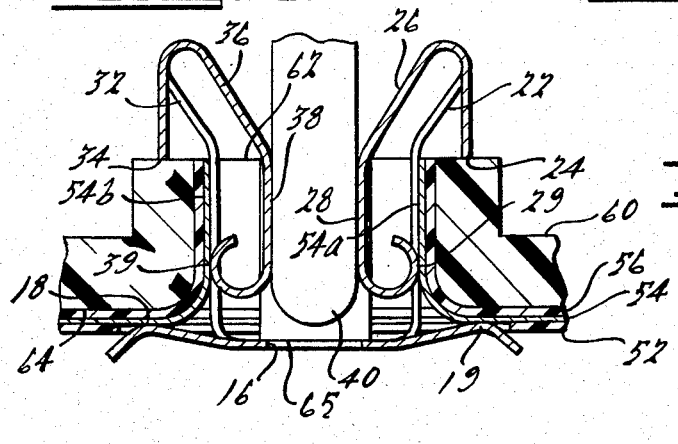
FIG. 6.

FLEXIBLE PRINTED CIRCUIT CONNECTOR

BACKGROUND OF THE INVENTION

The present invention is directed to the field of electrical sockets and more specifically to the area of sockets configured to provide interconnection between inserted male pin conductors and exposed conductor runs on a flexible printed circuit.

DESCRIPTION OF THE PRIOR ART

The use of flexible printed circuit material to provide wiring interconnects on the rear of instrument panels of automotive vehicles has become commonplace in the last several years.

In that regard, U.S. Pat. Nos. 4,191,441 and 4,348,071 respectively illustrate solutions to providing interconnection between a wire terminal and a flexible printed circuit and between a rigid printed circuit board and a flexible printed circuit.

U.S. Pat. No. 3,915,544 shows the construction of an electrical terminal which is employed to be insertable within a bottomed cavity of a rigid molded plastic material to provide a wipe down connection with laterally offset flexible printed circuit conductors. An aperture is provided in the upper end of the terminal to receive a male pin connector of an associated instrument. Spring arms are located beneath the aperture of the terminal to frictionally contact the inserted pin connector.

SUMMARY OF THE INVENTION

The present invention is a unitary retainer socket for providing a positive mechanical and electrical interconnection between an inserted male pin conductor and an exposed conductor run on a flexible printed circuit while the socket is retained in an aperture of a rigid panel.

It is an object of the present invention to provide an improved retainer socket configured to allow a great degree of latitude in the insertion area for the male pin conductor.

It is another object of the present invention to provide a retainer socket that can be installed in an open ended rectangular aperture of a rigid support panel so as to extend from both ends thereof and retain the flexible printed circuit material against the support structure.

It is still another object of the present invention to provide a socket that is self-locking to resist removal from the support panel aperture upon reception or removal of the male pin conductor with respect to the socket.

It is a further object of the present invention to provide a retainer socket that is effective to provide electrical contact to exposed conductor runs opposingly entering opposite sides of an area over the rectangular aperture of the rigid support panel when the male pin conductor is inserted into the socket.

BRIEF DESCRIPTION OF THE DRAWINGS

FIG. 1 is a perspective view of the unitary retainer socket of the present invention.

FIG. 2 is an elevated end view of the unitary retainer socket shown in FIG. 1.

FIG. 3 is a plan view of a flexible printed circuit material overlaying a rectangular aperture formed in a rigid support structure.

FIG. 4 is a plan view of the unitary retainer socket of FIG. 2 shown inserted into the rectangular aperture of the support structure shown in FIG. 3.

FIG. 5 is a cross-sectional end view taken along lines V—V in FIG. 4.

FIG. 6 is a cross-sectional view of the mounted unitary retainer socket with the male pin connector inserted.

DETAILED DESCRIPTION OF THE PREFERRED EMBODIMENT

The retainer socket 10 of the present invention is shown in FIGS. 1, 2, 4, 5, and 6 as being a single stamped and bent spring metal piece. A generally rectangular and planar base element 12 is central to the stamping and all elements are formed to extend symmetrically from the base. A first set of leg pairs 30 and 32 are shown as extending normally from the base element 12 separated across a contact space 37. A second pair of legs 20 and 22 extend from the opposite side of the base element 12 identical with and opposite the first pair of legs 30 and 32. Although the legs 30, 32, 20 and 22 extend generally normal from the base element 12, they are each bent outwardly at approximately their mid-length and extend to a distance where they are separated beyond the expected width of the aperture 62 that is discussed below. At the outward extension of each leg pair, a retrorse locking tab is formed and designated as 34, with leg pair 30 and 32, and 24, with leg pair 20 and 22. The retrorse locking tab is directed from the outer extension of the leg pairs back towards the direction of the base element 12.

A pair of holding spring tabs 18 and 19 also extend from the base element 12. Spring tab 18 extends from the base element 12 at approximately the same width as the contact space 37 between the leg pair 30 and 32 and is slightly inclined in the direction of the leg extensions so as to provide a biasing pressure against the flexible printed circuit material when the socket is installed.

Inner contact guides 36 and 26 are formed to provide continuous surfaces between each respective leg pair. The inner contact guides 36 and 26 extend from the outer portions of the leg pairs arm in an opposing relationship back towards the base element 12 in the space that separates the respective leg pairs. The lower portion 38 of the inner contact guide 36 and the lower portion 28 of the inner contact guide 26 are generally parallel and separated by a distance that is less than the width of an associated pin conductor for which the socket is intended to provide electrical interconnection.

Electrical contacts 39 and 29 are formed as a reverse bend extending from the lower portion of the inner contact guides 38 and 28, respectively. The contacts are configured so that insertion of the male pin conductor into the socket will cause outward movement of the electrical contacts 39 and 29 through the contact spaces defined between the corresponding leg pairs.

In FIGS. 3, 4, 5 and 6 a flexible printed circuit material 50 containing conductor run 54 is shown as being overlaid on a rigid support panel 60 having an aperture 62 formed therein. The flexible printed circuit material 50 is formed of a flexible insulative protection layer 52 overlaying a conductor foil run layer 54. The layers 52 and 54 are supported by a flexible backing layer 56. In the areas of the flexible printed circuit material 50 where the socket 10 is to be installed, portions of the protection layer 52 are removed to expose the conductor run 54. The exposed portion of the conductor run 54, is then diecut, in an "H" pattern to provide separate exposed conductor portions 54*a* and 54*b* to wrap over the side walls of the aperture 62, when the socket 10 is inserted therein. The aperture 62, in the support panel 60, is rectangular in cross-section, and extends from the rear surface 64 a predetermined distance to open on the front surface. Stop elements 63 and 65 are formed on opposing side walls of the aperture 62 and have ends which extend past the rear surface 64.

When the socket element 10 is inserted into the rear opening of the rectangular aperture 62 it is preferably through the use of automated insertion equipment utilizing the aperture 16 for gripping purposes. Upon insertion, the exposed conductor portions 54*a* and 54*b*, that have been defined by the "H" cut and placed over the aperture 62, are wiped into the rear opening of the aperture 62. The retrorse locking taps 34 and 24, after reaching the front end of the aperture 62 spring outward and provide a locking engagement with the front surface of the rigid support panel 60 to prevent removal of the socket 10 from the aperture 62. The spring tabs 18 and 19 provide biasing pressure against the oppositely locked retrorse locking tabs 34 and 24 to thereby hold the flexible printed circuit material 50 against the rear surface 64. Stop tabs 14 and 15 engage against the stop elements 63 and 65 to prevent further insertion of the socket.

Upon insertion of a male pin conductor 40, as shown in FIG. 6, the electrical contacts 39 and 29 are forced into compression against the side walls of the aperture 62 and the exposed conductor portions 54*a* and 54*b* to provide a positive interconnection between the male pin conductor 40 and the conductor run of the printed circuit.

Although the spring tabs 18 and 19 are shown in the figures as contacting the exposed surface of the conductor run 54, there may be occasions when insulated layer 52 has not been fully removed, but extends to a point whereby electrical contact is prevented by the spring tabs 18 and 19. Therefore, the compression forces, as a result of the inserted male pin conductor 40, applied to electrical contacts 29 and 39 against the rigid side walls of the aperture 62, provide that positive contact which is relied upon in the present invention. It should be pointed out, that the male pin conductor 40, shown herein, extends from a meter winding or other portion of an instrument. In addition, the length of the inner contact guide surfaces 26 and 36 transverse to the insertion direction provides for a noncritical insertion location of the male pin conductor 40 within a range defined by the length of those surfaces while at the same time achieving the reliable electrical connection that is desired.

It will be apparent that many modifications and variations may be implemented without departing from the scope of the novel concept of this invention. Therefore, it is intended by the appended claims to cover all such modifications and variations which fall within the true spirit and scope of the invention.

I claim:

1. A unitary retainer socket for providing a positive mechanical and electrical interconnection between a male pin conductor and a flexible printed circuit having exposed conductors while inserted in a walled aperture of a rigid support panel of a predetermined depth, comprising:

a generally planar base portion;

two pair of opposing legs extending in a generally normal direction from said base portion wherein the legs of each pair are separated by a defined contact space;

a pair of spring tabs extending from said base to provide resilient biasing of said socket against said flexible printed circuit when inserted in said panel aperture;

a retrorse locking tab extending from between each leg pair towards a corresponding spring tab;

an inner contact guide extending from each leg pair in a direction back towards said base portion forming continuous opposed surfaces separated by a distance that is less than the thickness of said male pin conductor for receiving and contacting said male pin conductor; and an electrical contact extending outwardly from each of said inner contact guides and being compressible by the insertion of said male pin conductor between said inner contact guides to positively compress the exposed conductors of said flexible printed circuit against opposing walls of said panel aperture.

2. A retainer socket as in claim 1, wherein each of said spring tabs extend from between a pair of legs and is slightly inclined from said base in a direction towards said legs.

3. A retainer socket as in claim 2, wherein each pair of opposing legs are separated from the other pair at their extreme ends remote from said base portion by a distance that is greater than the distance of separation at the base portion.

4. A retainer socket, as in claim 3, wherein said electrical contacts are oppositely located with respect to each other to be compressively forced through said defined contact space and into contact with the exposed conductor of said flexible printed circuit against the wall of said panel aperture.

5. A retainer socket, as in claim 4, for insertion into a rectangular aperture in said panel having a pair of stop elements protruding from opposing side walls, said socket further including a pair of stop tabs extending coplanar from said base portion in directions normal to the extension of said spring tabs to abut said stop elements when said socket is inserted into said rectangular aperture.

6. A retainer socket, as in claim 4, for insertion into a rectangular aperture in said panel having a pair of stop elements located along the shortest edges of the rectangular aperture and protruding outward therefrom and said socket further includes a pair of stop tabs extending coplanar from said base portion in directions normal to the extension spring tabs to abut the outward ends of said stop elements when inserted into said rectangular aperture.

7. A retainer socket as in claim 4, wherein the extreme ends of the leg pairs and the base portion are separated by a distance that is greater than the depth of the panel aperture so that said base portion and said retrorse tabs are outside the panel aperture when the socket is inserted therein.

* * * * *